United States Patent [19]

Brennan

[11] 4,309,651

[45] Jan. 5, 1982

[54] WIDE RANGE VOLTAGE REGULATOR CIRCUIT

[75] Inventor: Robert H. Brennan, Pittsfield, Mass.

[73] Assignee: General Electric Company

[21] Appl. No.: 176,849

[22] Filed: Aug. 11, 1980

[51] Int. Cl.[3] ..... G05F 1/14

[52] U.S. Cl. ..... 323/341; 336/148

[58] Field of Search ..... 323/255, 256, 340–342; 336/148

[56] References Cited

U.S. PATENT DOCUMENTS

| | | | |
|---|---|---|---|
| 2,342,084 | 2/1944 | Lennox | 323/342 |
| 2,358,631 | 9/1944 | Garin | 323/340 |
| 3,015,057 | 12/1961 | Alverson | 323/340 |
| 3,083,331 | 3/1963 | Spurway | 323/340 X |
| 3,287,624 | 11/1966 | Perry | 323/256 |
| 4,168,461 | 9/1979 | Fehlmann et al. | 323/341 |

*Primary Examiner*—A. D. Pellinen

*Attorney, Agent, or Firm*—Robert A. Cahill

[57] ABSTRACT

A wide range voltage regulator circuit exhibiting minimum circuit impedance at maximum output voltage employs a pair of regulating windings in series having their movable contact controlled by a plurality of normally open and normally closed limit switches. The extreme stationary contacts within the first regulating winding are connected with the movable contacts within the second regulating winding to provide a wide range of voltage regulation with negligible impedance at the maximum voltage position.

13 Claims, 2 Drawing Figures

WIDE RANGE VOLTAGE REGULATOR CIRCUIT

BACKGROUND OF THE INVENTION

Voltage regulator circuits employing a reactor coupled with a movable contact to provide current in full cycle and half cycle position of its tap changer is disclosed within U.S. Pat. No. 2,342,084. A transformer tap changing system employing a first and second pair of stationary contacts in tandem connection is described within U.S. Pat. No. 3,015,057 issued to Alverson. The Alverson patent provides a transformer tap changing system in which the reactive load introduced by the bridging reactor is substantially the same for all positions of the associated tap changer. A voltage regulator providing a wide range of voltage regulation is described in U.S. Pat. No. 4,168,461 issued to Fehlmann et al. This patent provides a wide range of voltage regulation by employing at least two regulators connected with their exciting windings in parallel and their series windings in series. All of the aforementioned U.S. patents are incorporated herein for purposes of reference.

The instant invention improves over the regulation disclosed within Fehlmann et al by employing a single voltage regulator having a common exciting winding and a tandem arrangement of a first and second regulating winding to provide both a wide range in voltage regulation and a negligible impedance at the maximum voltage position.

SUMMARY OF THE INVENTION

The invention comprises a voltage regulator having a first and second regulating winding wherein the last stationary contact in the first winding is electrically connected in series with the movable contact within the second winding. A pair of tap changer motor drives are employed together with a plurality of limit switches to ensure that the movable contact on the second winding does not leave its first position until the movable contact on the first regulating winding is at its last position.

DESCRIPTION OF THE PREFERRED EMBODIMENT

Figure 1:
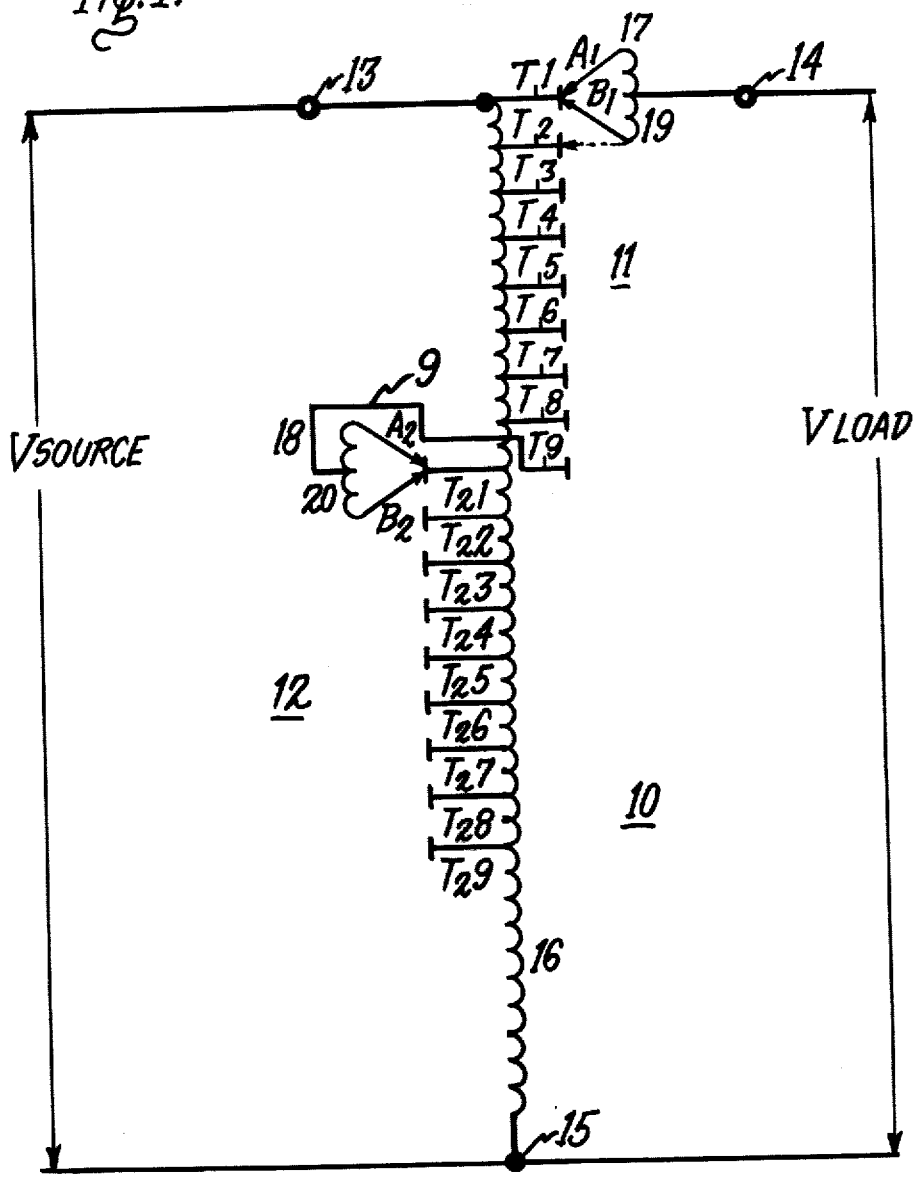
FIG. 1 is a circuit diagram showing the interconnection between the regulating winding and the exciting winding for the voltage regulator according to the invention.

The voltage regulator 10 shown in FIG. 1 consists of a first regulating winding 11 arranged around a magnetic core and divided into a plurality of stationary tap sections $T_11$–$T_19$ and a second regulating winding 12 divided into a second plurality of stationary tap sections $T_21$–$T_29$ for providing a wide range of voltage increments. One end of first regulating winding 11 is connected with terminal 13 which in turn is connected to one side of a voltage source. Terminal 14 is connected to one side of a voltage load and terminal 15 is a common terminal that is connected to the other side of the voltage source and the voltage load. A common exciting winding 16 is connected in series with first regulating winding 11 and second regulating winding 12 and is connected with common terminal 15.

Terminal 14 is connected with first regulating winding 11 by means of movable contact menmber 17 consisting of contacts $A_1$, $B_1$ and a first reactor 19. Second regulating winding 12 is connected in series with first regulating winding 11 in the following manner. Last stationary contact $T_19$ within first regulating winding 11 is electrically connected by means of connector 9 with second movable contact member 18 having a pair of movable contacts $A_2$, $B_2$ and a second reactor 20. The function of reactors 19 and 20 is fully described in aforementioned U.S. Pat. No. 2,342,084 and will not be described here. In order to provide for a full range of voltage regulation with minimum impedance at the maximum voltage position, regulator 10 is operated in the following manner. With first movable contact member 17 initially positioned at stationary contact position $T_11$ within first regulating winding 11, and with second movable contact member 18 positioned at stationary tap contact $T_21$ within second regulating winding 12, first movable contact member 17 can then travel from first stationary tap contact $T_11$ to last stationary tap contact $T_19$. When first movable contact member 17 contacts last stationary tap contact $T_19$, second movable contact member 18 can travel from second stationary tap contact $T_21$ to last second stationary tap contact $T_29$.

Figure 2:
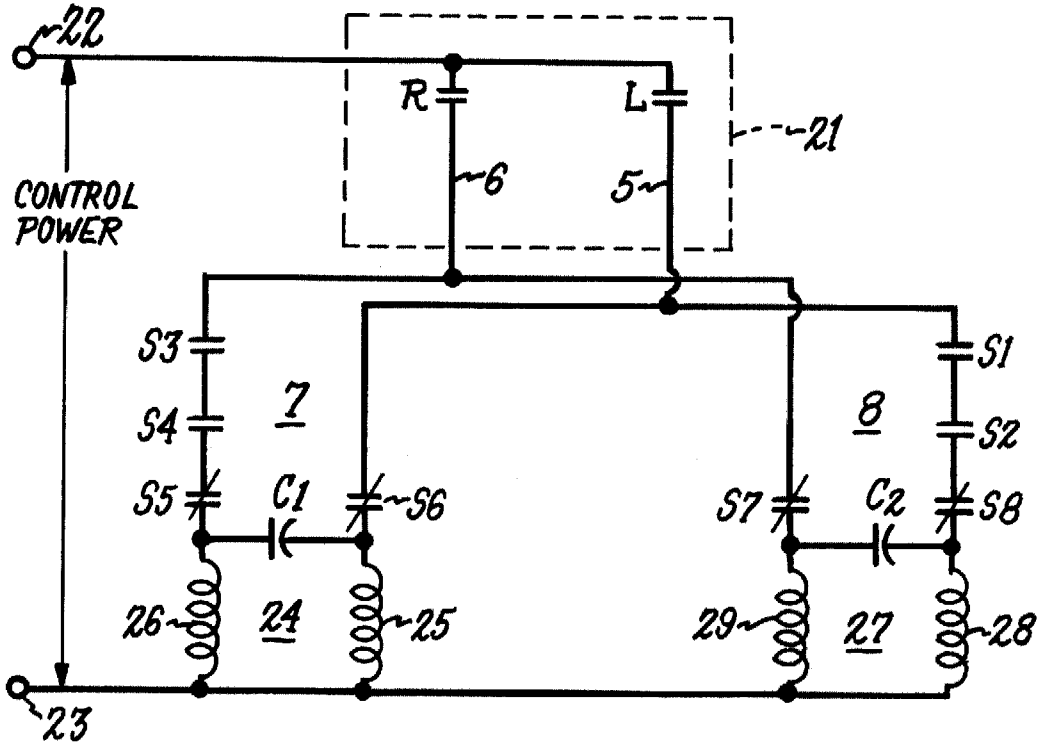
FIG. 2 is a schematic representation of the relationship between the pair of tap changer motors employed and the limit switches employed within the voltage regulator of the instant invention.

FIG. 2 shows the control arrangement for causing first movable contact member 17 and second movable contact member 18 to move only when first movable contact 17 contacts stationary tap contact $T_19$ and second movable contact member 18 contacts stationary tap contact $T_21$. Switch control assembly 21 contains raise control switch R and lower control switch L connected with raise control circuit 7 by means of connector 6 and with lower control circuit 8 by means of connector 5, respectively. Switch control assembly 21 is connected in series between power input terminls 22, 23, and provides for the connection of electrical power with first motor drive 24 and second motor drive 27 for moving movable contacts 17 and 18. Raise control circuit 7 consists of raise motor winding 26 within first motor 24 and raise motor winding 29 within second motor 27 and switches S3, S4, S5, and S7. Lower control circuit 8 consists of lower motor winding 25 within first motor 24 and lower motor winding 28 within second motor 27 and switches S1, S2, S8 and S6. Capacitor C1 in first motor 24 connects between raise motor winding 26 and lower motor winding 25. Capacitor C2 connects between lower motor winding 28 and raise motor winding 29 within second motor 27. Raise and lower control circuits 7 and 8, in combination with switch control circuit 21, operate in the following manner. When switch L is closed, power is provided through S6 to operate lower motor winding 25 in first motor drive 24 and cause movable contact unit 17 to traverse along stationary tap contacts $T_11$–$T_19$. When first movable contact member 17 contacts stationary tap contact $T_19$, switches S1 and S2, which are normally open, become closed and power is now provided through S8 to lower motor winding 28 is second motor drive 27. Switch S6 opens to prevent further motion of motor drive 25. Second movable contact member 18 is now caused to traverse along stationary tap contacts $T_21$–$T_29$. Switch S8 now opens to prevent further motion of motor drive 28.

When switch R is closed, power is supplied through S7 to operate raise motor winding 29 within second motor drive 27 causing second movable contact member 18 to traverse along stationary tap contacts $T_2$9 to $T_2$1. When second movable contact member 18 contacts stationary tap contact $T_2$1, S3 and S4 become closed, switch S7 opens and power is supplied through S5 to operate raise motor winding 26 in first motor drive 24. First movable contact member 17 is now caused to traverse back along first stationary tap contacts $T_1$9 to $T_1$1. Second movable contact member 18 cannot traverse along stationary tap contacts $T_2$1 to $T_2$9 until and unless first movable contact member 17 contacts last stationary tap contact $T_1$9 for closing S1 and S2 which are normally open. It is to be noted that first movable contact member 17 cannot traverse back along stationary tap contacts $T_1$9 to $T_1$1 unless and until second movable contact member 18 contacts stationary tap contacts $T_2$1, closing S3 and S4, which are normally open and opening S7, which is normally closed. Switches S5–S8 are normally closed and are standard limit switches normally used to stop further motion when the movable contacts 19 and 20 are at the extreme stationary contacts ($T_1$1, $T_1$9 and $T_2$1 and $T_2$9).

When first movable contact member 17 contacts stationary tap contact $T_1$1 and second movable contact member 18 contacts stationary tap contact $T_2$1 then maximum voltage will appear across terminals 14 and 15. Since the stationary top contacts $T_1$1 and $T_2$1 are at the first position in the first and second series windings 11, 12 respectively, the impedance at this voltage is at a minimum, since only reactor 19 carries load current.

Switches S1, S2 and S3,S4 are independently operated to provide redundant operation in the event of failure of one of the switches in the associated pairs S1, S2 and S3, S4.

It is to be noted that the tap changer arrangement of the instant invention permits the use of standard ten percent tap changers of the type normally employed for feeder voltage regulation by electric utilities.

The arrangement further allows stationary tap contacts $T_1$1–$T_1$9 and $T_2$1–$T_2$9 to be located in a pair of windings in series with the common winding 16. This requires the minimum amount of kilovolt amperes (KVA) capacity in the associated core and coils.

What we claim as new and desire to secure by Letters Patent of the United States is:

1. A voltage regulator comprising:

a first series winding arranged around an associated electromagnetic core and connected at one end to a first terminal;

a plurality of first tap windings within said first winding;

a plurality of first stationary contacts connected with each of said first tap windings;

a first movable contact for making contact with each of said first stationary contacts and with a second terminal for varying voltage output at said second terminal;

a second series winding electrically connected with said first series winding;

a plurality of second tap windings within said secondary winding;

a plurality of second stationary contacts connected with said second tap windings;

a second movable contact for making contact with each of said second stationary contacts; and an exciting winding wound around an associated electromagnetic core and connected with said second series winding and a third terminal, said third terminal providing a common connection between a voltage source and a voltage load.

2. The voltage regulator of claim 1 further including a reactor electrically connected with said first movable contact to provide electrical continuity between adjacent first pairs of said first stationary contacts when said first movable contact is moved across said adjacent first contact pairs.

3. The voltage regulator of claim 2 further including a second reactor connected with said second movable contact for providing electrical continuity between adjacent second pairs of said second stationary contacts when said second movable contact is moved across said adjacent second contact pairs.

4. The regulator of claim 1 wherein one of said stationary contacts in said first series winding is electrically connected with said second movable contact.

5. The regulator of claim 1 including a first motor having a pair of first and second windings for moving said first movable contact in both a first and a second direction.

6. The regulator of claim 5 including a second motor for moving said second movable contact in both said first and said second directions.

7. The regulator of claim 6 further including raise and lower first limit switches for starting and stopping said first motor when said first movable contact contacts one of said first limit switches.

8. The regulator of claim 7 further including raise and lower second limit switches for starting and stopping said second motor when said second movable contact contacts one of said second limit switches.

9. The regulator of claim 8 wherein said first and second limit switches are normally open and become closed upon contact with said first and second moving contacts.

10. The voltage regulator of claim 9 wherein said first limit switches are electrically connected in series with said first winding in said first motor and said second limit switches are electrically connected in series with said second winding within said second motor.

11. The voltage regulator of claim 10 further including a pair of first and second control switches electrically connected with said first and second limit switches for providing electrical power to said first and second motor windings.

12. The voltage regulator of claim 11 wherein said first and second control switches are normally open.

13. The voltage regulator of claim 10 wherein said first movable contact is on a predetermined first stationary contact for closing said first limit switches and said second movable contact is on a predetermined second stationary contact for closing said second limit switches.

* * * * *